United States Patent [19]

Lathrop

[11] Patent Number: 4,857,901

[45] Date of Patent: Aug. 15, 1989

[54] DISPLAY CONTROLLER UTILIZING ATTRIBUTE BITS

[75] Inventor: Olin G. Lathrop, Groton, Mass.

[73] Assignee: Apollo Computer, Inc., Chelmsford, Mass.

[21] Appl. No.: 77,161

[22] Filed: Jul. 24, 1987

[51] Int. Cl.[4] ..... G09G 1/16

[52] U.S. Cl. ..... 340/703; 340/799

[58] Field of Search ..... 340/703, 701, 798, 799, 340/721, 747

[56] References Cited

U.S. PATENT DOCUMENTS

| | | | |
|---|---|---|---|
| 4,016,544 | 4/1977 | Morita et al. | 340/703 |
| 4,303,986 | 12/1981 | Lans | 340/703 |
| 4,484,187 | 11/1984 | Brown et al. | 340/703 |
| 4,509,043 | 4/1985 | Mossaides | 340/703 |
| 4,574,277 | 3/1986 | Krause et al. | 340/703 |
| 4,672,368 | 6/1987 | Williams | 340/703 |

OTHER PUBLICATIONS

Entwisle, Jeffrey, "An Image Processing Approach to Computer Graphics", presented at the Conference on Computer Graphics and Interactive Techniques, Jul. 15–17, 1974.

*Primary Examiner*—David K. Moore
*Assistant Examiner*—Alvin Oberley
*Attorney, Agent, or Firm*—Lahive & Cockfield

[57] ABSTRACT

A processing system for controlling a computer graphics display stores and processes bit-mapped digital pixel values to generate color display signals. The system incorporates memory elements for storing control values for each pixel, in association with color values for each pixel. Processing modules responsive to the per-pixel control and color values generate color display signals. Embedding per-pixel control information in the bitmap in association with per-pixel color information enables each pixel to independently control the operation of the processing modules on that pixel.

12 Claims, 3 Drawing Sheets

PIXEL MODE SELECTION:

0: 8-BIT FALSE COLOR
1: 8-BIT FALSE COLOR; 4 OVERLAYS
2: 10-BIT FALSE COLOR; 2 OVERLAYS
3: 24-BIT REAL COLOR
4: 23-BIT REAL COLOR; 1 OVERLAY
5: 12-BIT REAL COLOR
6: MIXED MODE; 4 OVERLAYS
7: CONSTANT COLOR (FOR CURSORS)

DISPLAY CONTROLLER UTILIZING ATTRIBUTE BITS

BACKGROUND OF THE INVENTION

The present invention relates generally to the field of digital computers, and, in particular, relates to apparatus for controlling computer graphics displays.

Multiprocessing graphics workstations known in the art have the capability to run several applications or display different images concurrently. Such multiprocessing graphics workstations typically employ bitmap planes with per-screen control information, rather than color information, as a general mechanism to support per-screen video display mode specification. Display modes include selecting false color or real color, or using particular sections of a color lookup table.

The high cost of bitmap memory and the difficulty in achieving very fast memory cycle times in physically large RAM arrays has limited the resolution and plane count provided by bitmaps. "False color" configurations having four, eight or twelve planes have become a popular compromise between the cost of deep bitmaps and the desire for realistic colors. In a false color mode, all three red, green and blue (RGB) lookup tables (LUTs) receive data values from the same planes. In a real color mode, three sets of planes are used, with each set routed to a single LUT.

Recently, as RAM densities have soared, bitmap resolution and plane count have increased. 1-MByte and 4-Mbyte Video RAMs will continue this trend. Color lookup tables have also grown as static RAM density improves. Greater resolution has allowed engineering graphics workstations to usefully display multiple images or contexts on the same screen, and additional planes and larger lookup tables have presented the opportunity to interpret the bitmap in a variety of ways. A deficiency associated with per-screen display mode specification, typical of conventional graphics display systems, however, is that the entire screen is typically interpreted using one display mode.

Typically, a twenty-four plane configuration workstation must run real color, false color, and even monochrome graphics applications, some of which double-buffer images or reload color lookup tables. Since the display must be reconfigured or the lookup table altered for each, these applications cannot share the screen in conventional graphics display systems. Such whole-screen reconfiguration conflicts with the capability of multiprocessing workstations to use windows to share the screen among applications.

There is thus a conflict between the paradigm in multiprocessing workstations wherein the screen is composed of windows or images belonging to several independent contexts and the single screen-wide display interpretation mode such windows must share in conventional graphics systems.

If such mode information could be associated with windows or pixels rather than the whole screen, each application or image could define modes independently, and applications could share the screen more effectively.

If pixels can select by which "configuration" they are interpreted, then different windows can be displayed as needed without conflicts. For example, the pixels in one window could be marked as "twenty-four plane real color", whereas another window could be "eight-plane false color". Moreover, pixels in one window could be marked for a "fast clear mode" so as to reduce the time required to clear a window. The screen-wide display mode could be replaced by per-pixel display mode specification. Although commonly such specification will vary on a per-window basis, per-rectangle sub-windows, per-object, and even per-pixel variation would also be useful.

It is thus an object of the invention to provide an improved computer graphics display controller system.

It is a further object of the invention to provide a computer graphics display controller system which allows for flexible configuration of an image memory.

It is another object of the invention to provide a computer graphics display controller system in which the mode or configuration by which pixels are interpreted can be flexibly varied across a display screen.

It is a further object of the invention to provide a computer graphics display controller system which supports a per-pixel display mode specification.

It is yet another object of the invention to provide a computer graphics display controller system which allows faster dynamic displays by reducing the time required for clearing a new buffer.

SUMMARY OF THE INVENTION

The invention achieves the above objects by providing a system for embedding per pixel control information in the bitmap in addition to the color information, so that each pixel can control its own interpretation by the video-generating hardware, said hardware including a plane multiplexor. The invention discloses a digital processing system for controlling a computer graphics display, wherein the system stores and processes digital picture element (pixel) values corresponding to each of a plurality of display pixels. The system includes storage elements for storing first control values in association with the digital pixel values, and control elements, in communication with the storage elements, and responsive to the first control values, for controlling processing performed by the system.

The invention further provides attribute or display mode lookup table apparatus, in association with the storage elements, and including an array of memory locations addressable by the first control values. When addressed by the first control values, the attribute lookup table apparatus provides corresponding second control values which control processing performed by the system. Processing performed by the system is thus specified by control values associated with each pixel.

The invention includes apparatus for modifying a variety of display characteristics by plane multiplexing, responsive to control information associated with each pixel. Modifiable display functions include false color and real color mode selection and control. In false color mode, the same planes are routed to all three red, green and blue (RGB) lookup tables. Conversely, in real color mode, three sets of planes are routed separately, each set to a single color lookup table (LUT).

The invention also provides elements for variation of color lookup table origin, responsive to per-pixel control information, and in an embodiment having increased color lookup table size, several applications can share different areas within the same table.

The invention also provides apparatus for selecting a number of bitmap source planes, responsive to per-pixel control information, including selection of eight, ten, twelve or more planes of false color, or twelve or twenty-four plane real color.

The invention further provides elements for double buffer selection which can be made per-window; applications can switch buffers independently of each other, and singly-buffered applications need not write their images into more than one buffer.

The invention also includes apparatus for interpreting selected image planes as overlays, responsive to per-pixel control information. Applications which do not use overlays can disregard such selected image planes or use them in other ways. The invention also discloses elements, responsive to per-pixel control information, for forcing constant color, as for cursors, markers, and grids, which often are configured to occlude the underlying image without corrupting it.

The invention further includes apparatus responsive to per-pixel control information, for executing functions which include image filtering, highlighting for "overbright" and "blink" modes, validity or fast clear modes for substituting background color if a pixel is designated invalid, clipping during drawing, and leveling. Leveling utilizes a linear equation of the form $I=mx+b$, for offsetting black level and executing a contrast multiply.

The invention will next be described in connection with certain illustrated embodiments. However, it should be clear that various changes, modifications and additions can be made by those skilled in the art without departing from the scope of the invention as defined in the claims.

BRIEF DESCRIPTION OF THE DRAWINGS

For a fuller understanding of the nature and objects of the invention, reference should be made to the following detailed description and the accompanying drawings in which.

DESCRIPTION OF ILLUSTRATED EMBODIMENTS

Figure 1:
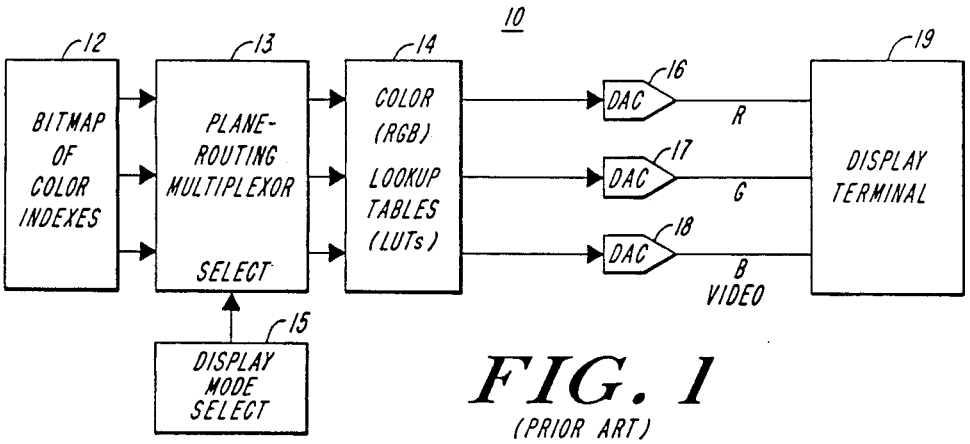
FIG. 1 (PRIOR ART)
FIG. 1 is a block diagram of a prior art computer graphics display controller system.

FIG. 1 is a block diagram of a prior art computer graphics display controller system 10, which includes bitmap 12, plane-routing multiplexor (MUX) 13, display mode select logic 15, color lookup tables (LUTs) 14, digital to analog converters (DACs) 16–18, and monitor 19. The bitmap 12 of color indexes is typically provided by a random access memory (RAM) which stores color indexes in an array of addressable locations. Moreover, bitmap 12 may be structured in a multiplane memory configuration known in the art. The information contained in the bitmap corresponds to picture elements (Pixels) on monitor 19, in a manner well known in the art. In a conventional display controller system, the bitmap stores values corresponding to red, green and blue (RGB) video signals.

Bitmap 12 transmits color index signals to plane-routing multiplexor 13, which selects from among memory planes in bitmap 12, responsive to signals received from display mode select logic 15. Digital values stored in selected planes are then transmitted to color (RGB) lookup tables (LUTs) collectively indicated by reference numeral 14. Color LUTs 14 can be provided by a plurality of RAMs, or by different sets of memory locations within a single RAM structure, as known in the art. Thus, in the illustrated system, digital pixel values are not routed directly to the DACs 16–18, but are instead used as an index into the color LUTs 14. The digital value of the indexed color LUT entry is then converted to an analog value used to control intensity or color on the monitor 19, in a manner known in the art.

The display mode logic 15 indicated in FIG. 1 is a static system, i.e., its output is based on the digital values transmitted by flipflops. Moreover, the conventional bitmap 12 of color indexes does not store display mode control values in association with each pixel value. The conventional structure illustrated in FIG. 1 thus requires that pixel values for the entire display screen be interpreted according to a single display mode. As discussed above, this single-mode-per-screen selection conflicts with the capability of multiprocessing workstations to provide multiple windows per screen. In particular, using the conventional system, all windows sharing a monitor screen would also have to share the same display mode.

Because rectangular windows represent very regular patterns in a bitmap, it is possible to make use of such regularity in generating pixel interpretation modes as the pixel values are transmitted out to become video. A wide variety of machines can be envisioned which generate programmable display mode information in synchrony with each window's video.

However, there is no inherent upper limit as to the number of windows or sub-windows which might exist on a screen, nor is there any limit to how frequently the mode may change on any one scanline of a raster display. Indeed, windows can be stacked up, offset by only a single pixel each, so the mode must be able to change at pixel rates. Without limits on frequency and complexity, the problem of generating window display mode information grows to equal that of emitting pixel colors.

Accordingly, the general approach utilized in the invention is to associate interpretation modes with the pixels themselves. Storing such mode information in additional planes, in association with the pixel information, delivers it in synchrony with the pixel color information to the video generating hardware without any constraints as to window number, position, shape, or size. Indeed, objects other than windows can have differentiating interpretation modes, so as, for example, to highlight a real-color object by displaying it from a different, independently alterable color lookup table.

Figure 2:
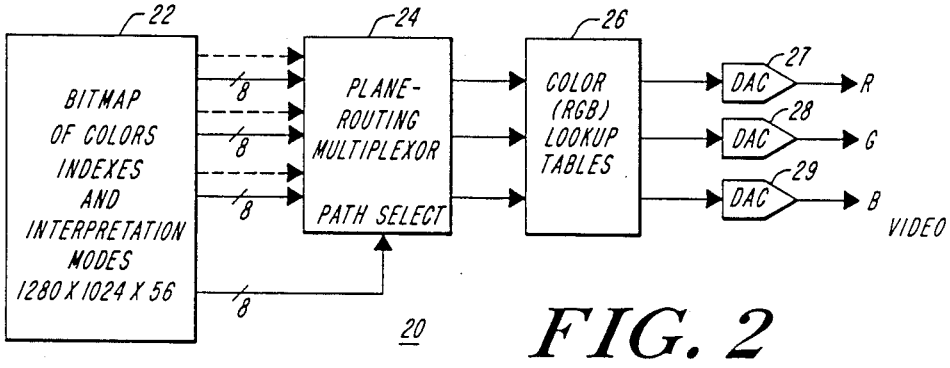
FIG. 2 is a block diagram of a computer graphics display controller system according to the invention.

The invention, an embodiment of which is illustrated as system 20 in FIG. 2, overcomes the deficiencies of conventional display controller systems by embedding per-pixel control information in the bitmap 22. The bitmap 22 is thus a bitmap of color indexes and interpretation modes. By storing a field of interpretation mode bits together with each color index in the bitmap 22, each pixel can control its own interpretation by video-generating hardware, including plane-routing control logic 24, RGB color lookup tables (LUTs) 26, and DACs 27–29.

Referring to FIG. 2, in one embodiment of the invention, multiplane bitmap 22 is of dimensions $1280\times1024\times56$ bits. In such an embodiment, eight bit red, green and blue color index signals are transmitted by bitmap 22 to plane-routing control logic 24. Additional RGB signals from bitmap 22 to control logic 24 in double-buffered mode are indicated in FIG. 2 by dashed lines.

Double buffering, as known in the art, involves storing images in two sets of planes, so that one image can be displayed on the monitor while another image is drawn. Double buffering permits much smoother screen motion, and crisper screen update, since only completed images are displayed.

Bitmap 22 also transmits to plane-routing control logic 24 path selection or interpretation mode signals. The mode signals are, in this embodiment of the invention, eight bit signals representative of eight bit mode or attribute values stored in bitmap 22 in association with each pixel value.

Plane-routing control logic 24 contains multiplexing elements, responsive to the eight bit path selection signals, for selecting from among plural bitmap planes. The operation of such multiplexing elements is known in the art. Digital values stored in selected memory planes in bitmap 22 are then transmitted to color LUTs 26. These values are converted to analog values by DACs 27–29, and are used as video signals capable of driving a video monitor.

The per-pixel multiplexing provided by the system 20, illustrated in FIG. 2, can be utilized for a variety of functions. In one embodiment of the invention, which supports applications wherein some display windows require a real color display mode and other windows require false color display, attribute bits stored in bitmap 22 are utilized to specify different true color/false color modes for each window.

False color involves using an n-bit color index which selects between $2^n$ independent colors, with the same n-bit index sent to all three RGB LUTs. Real color involves using three color indexes, sent separately to the RGB LUTs.

Similarly, in an embodiment wherein RGB LUT size is increased to accommodate several display applications, mode bits are utilized to specify different RGB LUT origins. Mode bits can also be used to select the number of bitmap source planes. In one embodiment of the invention, mode bits are utilized to select between combinations of eight or ten planes of false color, and between combinations of twelve or twenty-four planes of real color.

While the embodiment of the invention illustrated in FIG. 2 achieves significant advantages in flexibility of display mode specification and image memory usage, implementation of the simple multiplexing variations described above requires eight planes of pixel attributes, a 33% increase in bitmap size over a conventional bitmap having twenty-four RGB bits.

Figure 3:
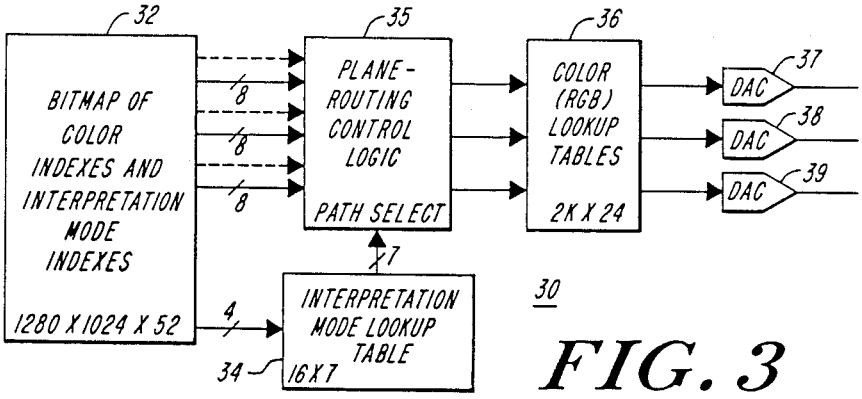
FIG. 3 is a block diagram of another embodiment of a controller system according to the invention.

One solution to this increase in size is to use indirection, as illustrated in FIG. 3. If the bitmap control planes hold an index into a table of attributes, rather than the attributes themselves, then an attribute's information is not limited by the number of bitmap planes; only the number of uniquely specified sets of attributes is limited. Thus, four planes could select among sixteen attributes which could be eight bits or more each. The capability to support sixteen attributes means that sixteen different windows or classes of windows, each displayed in a different way, could share the screen. FIG. 3 illustrates a preferred embodiment of the invention which utilizes such mode indexes.

Referring to FIG. 3, display controller system 30 utilizes a bitmap 32 of color indexes and interpretation mode indexes. The illustrated bitmap element 32 is of dimensions $1280 \times 1024 \times 52$ bits. Bitmap 32 transmits eight-bit RGB signals to plane-routing control logic 35, and transmits four-bit mode index signals to interpretation mode lookup table 34. Additional RGB signals from bitmap 32 to control logic 35 in double-buffered mode are indicated in FIG. 3 by dashed lines. In this embodiment, interpretation mode table 34 is of dimensions $16 \times 7$ bits. Interpretation mode table 34, addressed by the mode index signals from bitmap 32, transmits to plane-routing control logic 35 a seven bit path selection signal. Plane-routing control logic 35 utilizes the path selection signal to select from among bitmap planes, using multiplexing circuitry known in the art, and addresses color LUTs 36. Digital RGB pixel values from LUTs 36 are converted to analog values by DACs 37–39, and used as RGB video signals to drive a monitor.

There is thus one level of indirection in specifying each pixel's display mode. Just as the bitmap contains color indexes into the color LUT, rather than actual color values, so does each pixel's four bit attribute index specify which of sixteen attributes to use, rather than the attribute itself. This permits modifying the attributes associated with many pixels, by simply modifying one set of attribute bits.

Additionally, by using a pixel display mode LUT 34, the interpretation of the pixel values can take several forms. Instead of hard-wiring one or two modes, the interpretation is variable on a per-pixel basis, allowing different windows to be displayed in different modes. In particular, the sixteen values specified by the four-bit interpretation mode or attribute index signals each select one of sixteen attribute fields stored in interpretation mode LUT 34. The per-pixel interpretation mode field can thus select one of sixteen ways of processing the RGB bits associated with each pixel in the planes of bitmap 32.

Moreover, because cursor characteristics can also be encoded in these attributes, cursor activity and drawing activity do not affect each other, and thus the RGB image need not be corrupted by the cursor.

Figure 5:
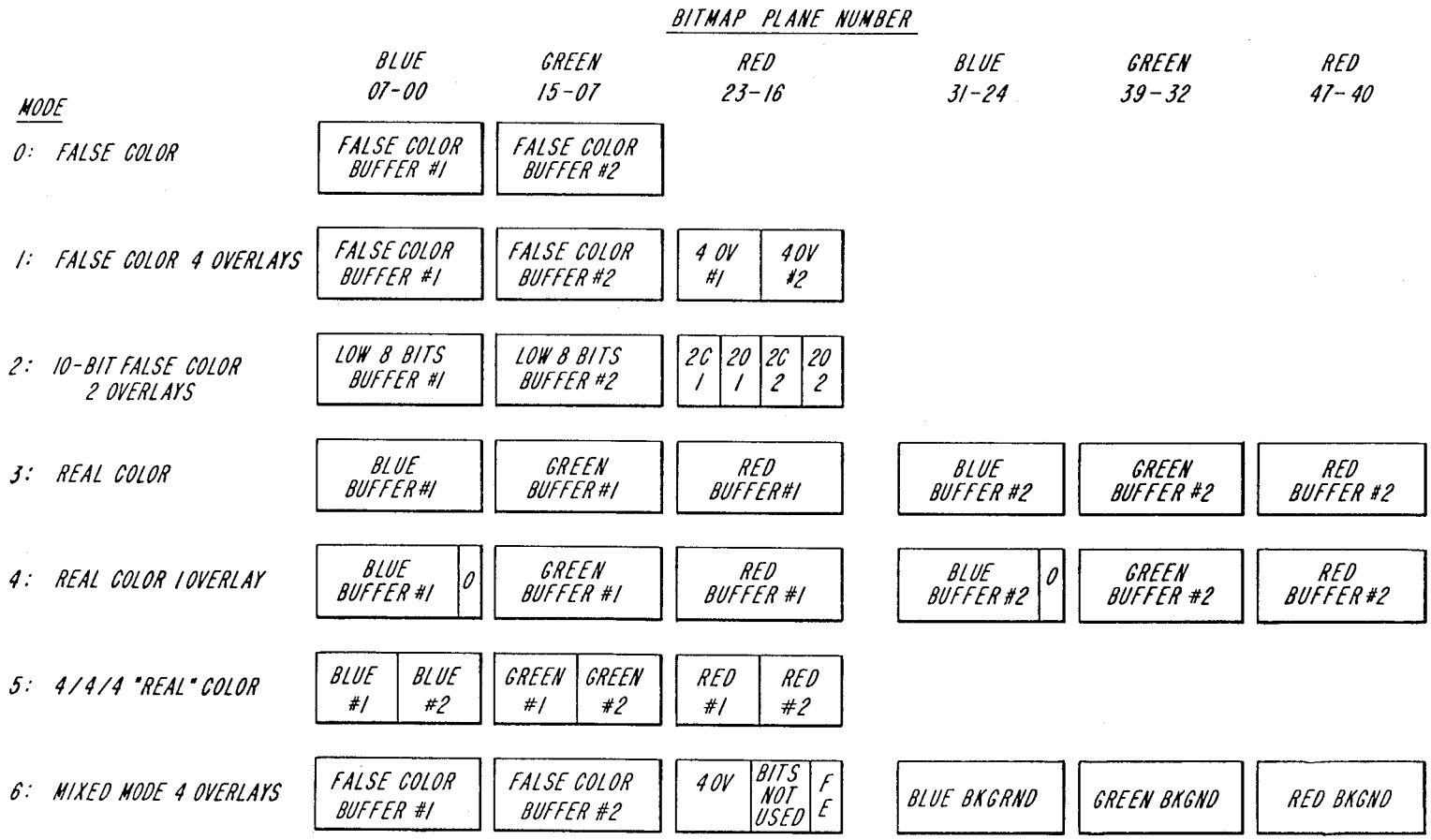
FIG. 5 is a block diagram illustrating bitmap plane multiplexing configuration utilized in a preferred embodiment of the invention.

In a preferred embodiment of the invention, there are eight pixel display modes, supporting a variety of false color v. real color, double buffering, and overlay combinations. These combinations are illustrated in FIG. 5. Overlays are a separate image which is displayed "in front of"or overlaying the normal image. When an overlay has a non-zero value, it forces the corresponding pixels to the overlay's color. When an overlay has a zero value, the underlying image is seen. Overlays are useful for annotating the underlying image. By maintaining such annotations on planes separate from the planes storing the normal image, the normal image is not corrupted, and the annotation can be edited, scrolled and otherwise processed independently.

Figure 4:
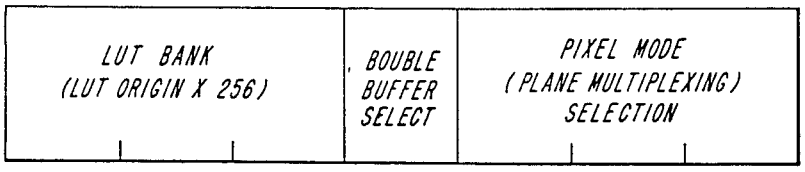
FIG. 4 is a block diagram illustrating the bits of a multi-bit mode word.

In a further preferred embodiment of the invention, each interpretation mode or attribute is specified by a seven bit field, as illustrated in FIG. 4. The seven bit field illustrated in FIG. 4 is stored in the bitmap 22 in the embodiment illustrated in FIG. 2, or in the interpretation mode table 34 in the embodiment illustrated in FIG. 3. The seven bits are used to specify a color lookup table origin, double buffer on/off selection, and plane multiplexing. The multiplexing values are used to combine and route data stored in the bitmap color mode planes to addresses for the color lookup tables 36, which in a preferred embodiment are 2K×24 bits.

Thus, the four-bit mode or attribute index values from bitmap 32 each select one of sixteen attributes, each of which in turn specifies the method by which bitmap planes or cursor color are assembled as a color LUT index for a given pixel. The attribute indexes are preferably updated whenever the cursor moves or the window configuration changes.

The seven bit field illustrated in FIG. 4 includes three LUT Bank bits, one Double Buffer Select bit, and three Pixel Mode or plane multiplexing selection bits. The three color bits that make up the LUT BANK provide the upper three color LUT index bits for pixel display. The Double Buffer Select bit selects which of two buffers is to be displayed for double-buffered windows.

The three Pixel Mode or plane multiplexing selection bits specify eight ways of selecting and combining bitmap planes to produce a color LUT index. In a preferred embodiment of the invention, those eight configurations are defined as illustrated in FIG. 5. FIG. 5 illustrates combinations of bits from 48 planes, numbered zero through 47, in bitmap 32. The "Ov" and "0" bits are overlay bits, and the "C" bits are color bits.

The eight configurations are eight-bit false color, eight-bit false color with four overlays, ten-bit false color with two overlays, twenty-four bit real color, twenty-three bit real color with one overlay, twenty-four bit real color, referred to as "four/four/four real color", mixed mode with four overlays, and constant color.

Software code utilized in conjunction with the display modes according to the invention is set forth in Appendix 1, incorporated herein.

In a preferred practice of the invention, a "fast clear" system is provided for rapidly clearing selected windows or an entire screen. This fast clear system can be implemented in either the "direct environment" of the embodiment illustrated in FIG. 2, or in the "indirect environment" of the embodiment illustrated in FIG. 3.

Thus, in a further preferred embodiment of the system illustrated in FIG. 3, supporting eight utility planes, each pixel can have these attribute bits stored in interpretation mode LUT 34:

| #bits | Attribute |
|---|---|
| 3 | EITHER: Upper LUT bits or Cursor color |
| 1 | Cursor enable |
| 1 | Double Buffer select if fast clear disabled |
| 2 | Valid bits for each buffer for fast clear mode |
| 1 | Fast clear enable |

Z refers to Z-coordinate or depth information.

The "Double Buffer Select" bit selects which of two possible eight- to twentyfour-plane images is displayed on the screen. "Fast Clear Enable" and "Pixel Valid" attribute bits are provided in association with each pixel. In accordance with the invention, pixels with Fast Clear enabled can be bulk-reset to a background color by being marked as invalid. Drawing operations set the affected pixels as valid. The "Pixel Valid" bits are unconditionally set and reset, but are ignored if "Fast Clear Enable"is off.

Fast clear in the embodiment illustrated in FIG. 3 requires two additional bits in the mode or attribute index field stored in bitmap 32, and for each window class, an additional bit in the attribute or mode field stored in mode LUT 34. A "Valid Bit"for each pixel is required for each of the two buffers used when double buffering. Fast clear then makes use of the "Double Buffer Select" bit in the attribute field, and requires an additional "Fast Clear Enable" bit in the attribute field for each window class.

When fast clear is used in the indirect environment, the "Fast Clear Enable" bit is set in the windows which are selected for fast clear treatment. Then the "Pixel Valid" bits are cleared using either a full screen clear operation or a window clear operation for the buffer which is selected by a respective "Valid Bit" for drawing.

The "Buffer Select" bit shown in FIG. 4 is used by the video generating hardware to determine which buffer to display. This allows double buffering pixel by pixel, which is useful in double buffering individual windows. If "Fast Clear Enable" is "on" then the video generating hardware disregards the "Buffer Select" bit, and the determination of which buffer to display is made from a pre-programmed one bit register in plane-routing logic 35. For each buffer, the "Buffer Cleared" bit causes the video hardware to display preset values instead of the value in image memory. A Z compare mechanism, known in the art, is used to sample the "Fast Clear" bit and the appropriate "Buffer Cleared" bit to emulate reading a preprogrammed value from the Z buffer.

When a window is operating in "Fast Clear" mode, all the "Fast Clear Enable" bits are set to "on" for this window, and "off" for the rest of the screen. To swap buffers for this window, one register in the video section, or control logic 35, is reprogrammed.

If two of the utility plane attribute bits for each pixel are allocated to represent "Pixel Valid" for each buffer, and the system substitutes a background color for the RGB value of every invalid pixel, then a window or sub-window can be implicitly cleared by clearing the "Pixel Valid" bits. In a preferred embodiment of the invention, drawing operations set this bit; Z-buffered drawing reads the bit to determine whether the Z value is valid, and then sets the bit.

Because the "Pixel Valid" bits can be cleared quickly, the window is quickly cleared, because the display video will show the background color. Z-compares, known in the art, are forced to enable writing.

Since the above-described mechanism can be gated by another "Fast Clear Enable" utility plane which has bits asserted only in the window of interest, a fast clear of all the valid bits, inside and outside the window, will have an effect only on the window pixels. A preferred embodiment of the invention executes fast clear of an entire plane utilizing VRAMs via a serial port. This eliminates the problem of serial write operations not being limitable to window boundaries.

Thus, to clear a buffer, the appropriate "Buffer Cleared" bit is set for the entire screen. In accordance with the invention, the "Fast Clear Enable" bit is gated with the "Buffer Cleared" bit so that the "Buffer Cleared" bit only affects the desired window. Moreover, any write operations to the buffer always turn the corresponding "Buffer Cleared" bit "off" for each pixel that is written.

In a system according to the invention, a buffer can be cleared much faster than with conventional systems because the appropriate "Buffer Cleared" bit can be set for the entire screen without regard to the window boundaries.

These "Pixel Valid" and "Fast Clear Enable" bits are, in a preferred embodiment of the invention, implemented with video RAMs (VRAMs), which can be gang-cleared, as known in the art, by writing to memory through shift registers which form a part of the VRAMs. This permits swapping buffers and clearing the non-displayed buffer in a small fraction of a frame time. In a conventional system, assuming 12.5 nanoseconds write time per pixel, clearing the entire screen would require $1280\times1024\times12.5$ nanoseconds=0.98 frame times (assuming 60 Hz refresh speed). The fast clear feature leaves about twice as much time available to writing the next image when executing real time (30Hz) animation.

In summary, the fast clear feature of the invention utilizes the ability to set entire planes to fixed values very quickly to indicate state over a region that is statically flagged. "Fast Clear Enable" flags the region, and "Buffer Cleared" bits indicate the state. "Fast Clear Enable" is preferably n bits wide, to define $2^n$ display regions.

A fast clear as described above does not invert the "Double-Buffering Select" bit, because that bit would have to be inverted only within the window of interest. Instead, in order to avoid double buffering pixels other than those in the window being cleared, the video hardware uses a "Mode Flop" bit as the "Double Buffer Select" for the selected window, detecting the selected window pixels by their "Fast Clear Enable" plane bits.

It will thus be seen that the invention efficiently attains the objects set forth above. In particular, the invention provides an improved computer graphics display controller system having a wide range of flexible display modes controllable by control information stored in association with each pixel. It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

Appendix 1 atg_$get_rgb.pas

```
{   Subroutine ATG_$GET_RGB (X,Y,RGB)
*
*   Return the 24 bit RGB value that would go to the D/A converters
*   for a given pixel coordinate.  X and Y are the coordinate of the
*   pixel.  RGB is returned as 4 bytes.  The first byte is not used.
*   The next 3 bytes are red, green, and blue in that order.
*
*   This subroutine takes into account the attribute bits, and simulates
*   the various pixel modes and the look up tables.
}
module atg_$get_rgb;
define atg_$get_rgb;
%include '/olin_dsee/atg/atg2.ins.pas';

var
  attr: integer16;                      {attribute bits value at this pixel}
  rlut, glut, blut: integer16;          {red, green, blue lut index values}
  class: wind_class_type;               {window class descriptor}
  mode: integer16;                      {pixel mode with double buffer bit in LSB}
  bank: integer16;                      {look up table bank mask}
  ov_mask: integer16;                   {overlay bits aligned at the lsb}
  pixel: ^atg_$pixel_type;              {pointer to this pixel in bitmap}
  status: status_$t;                    {error code}
  lut_adr: atg_$lut_adr_type;           {composite LUT adr for watch LUT adr feature}
  dac_val: atg_$argb_pixel_type;        {DAC data for watch DAC value feature}

procedure atg_$get_rgb;

label
  cursor, do_lut;
{
*******************************************************************************
*
*   Internal subroutine CHECK_OVERLAYS (N)
*
*   Check for any overlay plane bits being turned on.  N is the number of overlay
*   bits in OV_MASK.  The highest priority overlay bit is in the lsb of OV_MASK.
*   Any unused high bits of OV_MASK should be set to zero.  The value in OV_MASK
*   is trashed.
*
*   If none of the overlay plane bits are found to be turned on (=1), then
*   CHECK_OVERLAYS just returns.  Otherwise, RLUT, GLUT, and BLUT are set to the
*   appropriate values for the overlay plane found, and a jump is taken to
*   the label DO_LUT in the main subroutine.
```

```
}
procedure check_overlays (
  in      n: integer16);                {number of overlay planes}

var
  i: integer16;                         {current overlay plane number}

label
  found_overlay;

begin

  if ov_mask = 0 then return;           {all overlay bits off ?}
  for i := 0 to n-1 do begin            {once for each overlay plane}
    if (ov_mask & 1) <> 0 then          {this overlay plane bit is turned on ?}
      goto found_overlay;               {we found an ON overlay plane bit}
    ov_mask := rshft(ov_mask,1);        {shift next overlay plane bit into position}
    end;                                {back and check this new overlay plane bit}
  return;                               {did find any overlay bits on}

found_overlay:                          {found highest priority overlay bit that was on}
  rlut := lshft(class.lut_bank & 7,4) ! 128; {block number based on lut bank number}
  rlut := rlut ! i;                     {merge in offset within overlay block}
  glut := rlut;                         {copy lut index to other colors}
  blut := rlut;
  goto do_lut;                          {lut indicies completely set, do look up}
  end;
{
*******************************************************************************
*
*   Body of main routine.
}
begin
  pixel := addr(bitmap[y,x]);           {make pointer to this pixel}
  attr := pixel^.attr;                  {get attribute index}
  class := wind_class[attr];            {get the window class in use for this pixel}
  mode := lshft(class.pix_mode & 15,1) ! (class.dbl_buf & 1); {mode with dbl buf bit}
  case mode of                          {8 pixel modes, each with buffer select option}
{
*   Mode 0, buffer 1.
*   8 bit pseudo color.
}
0: begin
  rlut := pixel^.blu1;                  {all lut indices to same value (false color)}
  glut := rlut;
  blut := rlut;
  end;
{
*   Mode 0, buffer 2.
*   8 bit pseudo color.
}
1: begin
  rlut := pixel^.grn1;                  {all lut indices to same value (false color)}
  glut := rlut;
  blut := rlut;
  end;
{
*   Mode 1, buffer 1.
*   8 bit pseudo color with double buffered 4 bit overlay planes.
}
2: begin
  ov_mask := rshft(pixel^.grn1,4);      {get 4 overlay planes}
  check_overlays (4);                   {check overlay planes}
  rlut := pixel^.blu1;
  glut := rlut;
  blut := rlut;
  end;
{
*   Mode 1, buffer 2.
*   8 bit pseudo color with double buffered 4 bit overlay planes.
```

```
}
3: begin
  ov_mask := pixel^.grnl & 15;          {get 4 overlay planes}
  check_overlays (4);                   {check overlay planes}
  rlut := pixel^.grnl;
  glut := rlut;
  blut := rlut;
  end;
{
*   Mode 2, buffer 1.
*   8 bit pseudo color with 16 bit overlays.
}
4: begin
  ov_mask := lshft(pixel^.grnl,8)       {assemble overlay bits}
    ! pixel^.redl;
  check_overlays (16);                  {check 16 overlay planes}
  rlut := pixel^.blul;
  glut := rlut;
  blut := rlut;
  end;
{
*   Mode 2, buffer 2.
*   8 bit pseudo color with 16 bit overlays.
}
5: begin
  ov_mask := lshft(pixel^.grn2,8)       {assemble overlay bits}
    ! pixel^.red2;
  check_overlays (16);                  {check 16 overlay planes}
  rlut := pixel^.blu2;
  glut := rlut;
  blut := rlut;
  end;
{
*   Mode 3, buffer 1.
*   10 bit pseudo color with 2 overlay plane.
}
6: begin
  ov_mask := rshft(pixel^.blul,4) & 3;
  check_overlays (2);
  rlut := (rshft(class.lut_bank,8) & 16#400) {top bit comes from lut bank field}
    ! (lshft(pixel^.blul,2) & 16#0300) {next two bits of lut bank}
    ! pixel^.grnl;                     {lut index within bank}
  glut := rlut;
  blut := rlut;
  goto do_lut;                          {LUT indicies all set}
  end;
{
*   Mode 3, buffer 2.
*   10 bit pseudo color with 2 overlay plane.
}
7: begin
  ov_mask := pixel^.blul & 3;
  check_overlays (2);
  rlut := (rshft(class.lut_bank,8) & 16#400) {top bit comes from lut bank field}
    ! (lshft(pixel^.blul,6) & 16#0300) {next two bits of lut bank}
    ! pixel^.redl;                     {lut index within bank}
  glut := rlut;
  blut := rlut;
  goto do_lut;                          {LUT indicies all set}
  end;
{
*   Mode 4, buffer 1.
*   24 bit real color.
}
8: begin
  rlut := pixel^.redl;
  glut := pixel^.grnl;
  blut := pixel^.blul;
  end;
```

```
[
*   Mode 4, buffer 2.
*   24 bit real color.
]
9: begin
  rlut := pixel^.red2;
  glut := pixel^.grn2;
  blut := pixel^.blu2;
  end;
[
*   Mode 5, buffer 1.
*   23 bit real color with 1 overlay plane.
]
10: begin
  ov_mask := pixel^.blu1 & 1;
  check_overlays (1);
  rlut := pixel^.red1;
  glut := pixel^.grn1;
  blut := pixel^.blu1 & 8#376;          {mask off low bit of blue}
  end;
[
*   Mode 5, buffer 2
*   23 bit real color with 1 overlay plane.
]
11: begin
  ov_mask := pixel^.blu2 & 1;
  check_overlays (1);
  rlut := pixel^.red2;
  glut := pixel^.grn2;
  blut := pixel^.blu2 & 8#376;          {mask off low bit of blue}
  end;
[
*   Mode 6, buffer 1.
*   12 bit real color.
]
12: begin
  rlut := (pixel^.red1 & 16#0F0) ! (rshft(pixel^.red1,4) & 16#0F);
  glut := (pixel^.grn1 & 16#0F0) ! (rshft(pixel^.grn1,4) & 16#0F);
  blut := (pixel^.blu1 ~~16#0F0~~ ! (rshft(pixel^.blu1,4) ~~16#0F~~);
  end;                  & 16#0F0)                          & 16#0E);
[
*   Mode 6, buffer 2.
*   12 bit real color.
]
13: begin
  rlut := (lshft(pixel^.red1,4) & 16#0F0) ! (pixel^.red1 & 16#0F);
  glut := (lshft(pixel^.grn1,4) & 16#0F0) ! (pixel^.grn1 & 16#0F);
  blut := (lshft(pixel^.blu1,4) & 16#0F0) ! (pixel^.blu1 & 16#0F);
  end;
[
*   Mode 7, buffer 1.
*   12 bit real color with 12 bits of overlay.
]
14: begin
  ov_mask := (rshft(pixel^.blu1,4) & 16#00F)
    ! (pixel^.grn1 & 16#0F0)
    ! (lshft(pixel^.red1,4) & 16#0F00);
  check_overlays (12);
  rlut := (lshft(pixel^.red1,4) & 16#0F0) ! (pixel^.red1 & 16#0F);
  glut := (lshft(pixel^.grn1,4) & 16#0F0) ! (pixel^.grn1 & 16#0F);
  blut := (lshft(pixel^.blu1,4) & 16#0F0) ! (pixel^.blu1 & 16#0F);
  end;
[
*   Mode 7, buffer 2.
*   12 bit real color with 12 bits of overlay.
]
15: begin
  ov_mask := (rshft(pixel^.blu2,4) & 16#00F)
    ! (pixel^.grn2 & 16#0F0)
```

```
    ! (lshft(pixel^.red2,4) & 16#0F00);
  check_overlays (12);
  rlut := (lshft(pixel^.red2,4) & 16#0F0) ! (pixel^.red2 & 16#0F);
  glut := (lshft(pixel^.grn2,4) & 16#0F0) ! (pixel^.grn2 & 16#0F);
  blut := (lshft(pixel^.blu2,4) & 16#0F0) ! (pixel^.blu2 & 16#0F);
  end;
{
*   Mode 8, buffer 1.
*   8 bit double buffered pseudo color with 8 bit single buffered overlay.
}
16: begin
  ov_mask := pixel^.grn1;
  check_overlays (8);
  rlut := pixel^.blu1;
  glut := rlut;
  blut := rlut;
  end;
{
*   Mode 8, buffer 2.
*   8 bit double buffered pseudo color with 8 bit single buffered overlay.
}
17: begin
  ov_mask := pixel^.grn1;
  check_overlays (8);
  rlut := pixel^.red1;
  glut := rlut;
  blut := rlut;
  end;
{
*   Mode 9.
*   Cursor color.  The high 8 bits of the LUT index come from the
*   CURSOR ORIGIN register, and the low 3 bits come from the LUT BANK
*   field in the window class descriptor.
}
18: goto cursor;
19:
cursor: begin
  rlut := (cursor_origin & 16#07F8) ! (class.lut_bank & 7);
  glut := rlut;
  blut := rlut;
  goto do_lut;
  end;

otherwise                              {unrecognized pixel mode, complain about it}
  status.all := atg_$unimp_pix_mode;
  atg_$error (status,'Uniplemented pixel display mode.');
  return;

end;                                   {done with all the pixel modes}
{
*****************************************************************************
*
*   The low 8 bits of RLUT, GLUT, and BLUT have been set.  Add on the bank select
*   bits and index into the look up tables to find the real color.
}
  bank := lshft(class.lut_bank & 7,8); {position 3 bit lut bank field}
  rlut := (rlut & 255) ! bank;         {merge bank onto indicies}
  glut := (glut & 255) ! bank;
  blut := (blut & 255) ! bank;
{
*   RLUT, GLUT, and BLUT are the final look up table index values.  Now use them
*   into the LUT to get the real color.
}
do_lut:                                {jump here from cursor colors}
  if lut_adr_proc <> nil then begin    {somebody wants to watch all LUT addresses ?}
    lut_adr.unused := 0;               {clear unused bits}
    lut_adr.bank := rshft(rlut,8);     {grab bank field from red LUT address}
    lut_adr.red := rlut & 255;         {offset into bank for each color}
```

```
  lut_adr.grn := glut & 255;
  lut_adr.blu := blut & 255;
  lut_adr_proc^ (x,y,lut_adr);          {tell user of this LUT address}
  end;
rgb.alpha := 255;                       {set alpha value to max opaque}
rgb.red := ord(red_lut[rlut]);          {index into LUTs to find real color}
rgb.grn := ord(grn_lut[glut]);
rgb.blu := ord(blu_lut[blut]);
if dac_val_proc <> nil then begin       {somebody wants to watch all DAC color values ?}
  dac_val.all := 0;                     {init all bits to zero}
  dac_val.red := rgb.red;               {fill in 24 bit DAC color}
  dac_val.grn := rgb.grn;
  dac_val.blu := rgb.blu;
  dac_val_proc^ (x,y,dac_val);          {tell user of this DAC value}
  end;
end;
```

It is also to be understood that the following claims are intended to cover all the generic and specific features of the invention as described herein, and all statements of the scope of the invention which, as a matter of language, might be said to fall therebetween.

Having described the invention, what is claimed as new and secured by letters patent is:

1. In a system for controlling a computer graphics display, wherein said system stores and processes digital pixel values corresponding to respective display pixels, said system including a color component lookup table element having an array of memory locations for storing digital color component values, the color component lookup table element being addressable by selected multiple-bit digital index values, the improvement comprising storage means for storing first control values in association with each digital pixel value, display mode lookup table means, including an array of memory locations, the display mode lookup table being addressable by said first control values, for generating second control values corresponding to respective pixels, and control means, in communication with said display mode lookup table means and said storage means, for generating the multiple-bit digital index values in response to a combination of said second control values and said digital pixel values.

2. In a system according to claim 1, the further improvement wherein said control means includes means, responsive to said second control values, for writing said pixel values into said color component lookup table element.

3. In a system according to claim 1, the further improvement wherein said control means includes means, responsive to said second control values, for addressing the color component lookup table element with selected multiple-bit digital index values, wherein selected bits of said multiple-bit digital index values include said pixel values.

4. In a system according to claim 1, the further improvement wherein said storage means includes a plurality of memory locations organized into plural memory planes associated with given display areas, and wherein said control means includes means, responsive to said second control values, for designating a set of memory planes associated with each of said given display areas, and for selecting relative priority of said memory planes associated with a given display area.

5. In a system according to claim 1, the further improvement wherein said pixel values are represented by multiple bit data words, bit positions in said data words corresponding to selected pixel characteristics, and wherein said control means includes means, responsive to said second control values, for selecting pixel characteristics corresponding to bit positions in said data words.

6. In a system according to claim 1, the further improvement comprising memory means, including first and second memory buffers, for storing digital pixel values in said first and second memory buffers, and wherein said control means includes display control means for controlling the display in response to values stored in a selected one of said first and second memory buffers, said display control means includes buffer selecting means for selecting, in response to said second control values, one of said first and second memory buffers.

7. In a system according to claim 1, the further improvement wherein said storage means includes means for storing an override control value representative of an override color, and wherein said control means includes means, responsive to said override value, for generating an override color output.

8. In a system according to claim 1, the further improvement wherein said system provides plural display windows, wherein said storage means includes means for storing a validity indicator associated with a given window, and wherein said control means includes means, responsive to said validity indicator, for substituting pixel values representative of a predetermined state for pixel values associated with pixels corresponding to said window.

9. In a system according to claim 1, the further improvement wherein said storage means contains means for storing, in association with a given pixel, a third control value, said third control value designating, as time variant, other values stored with said given pixel, and wherein said control means includes means, responsive to said second control values, for varying said other values stored with said given pixel.

10. In a system according to claim 1, the further improvement wherein said storage means includes means for storing display area control values, said display area control values designating selected display areas for predetermined drawing processing, and wherein said control means includes means, responsive to said display area control values and said second control values, for masking off selected pixel values.

11. In a system according to claim 1, the further improvement wherein said storage means includes means for storing arithmetic process control values indicative of selected arithmetic operations to be executed on pixel values corresponding to selected display areas, and wherein said control means includes means, responsive to said arithmetic process control values and said second control values, for enabling execution of said selected arithmetic operations on said pixel values corresponding to said selected display areas.

12. In a system according to claim 4, the further improvement wherein said memory planes include a set of overlay memory planes, said overlay memory planes being arithmetically combinable in accordance with selected overlay plane encodings, said storage means includes means for storing overlay control values indicative of selected overlay plane encodings, and said control means includes means, responsive to said overlay control values and said second control values, for arithmetically combining selected ones of said overlay memory planes.

* * * * *

UNITED STATES PATENT AND TRADEMARK OFFICE

CERTIFICATE OF CORRECTION

PATENT NO. : 4,857,901

DATED : August 15, 1989

INVENTOR(S) : Lathrop, et al

It is certified that error appears in the above-identified patent and that said Letters Patent is hereby corrected as shown below:

Title page, item [19] should read as follows:

--Lathrop et al--

Item [75] should read as follows:

--Olin G. Lathrop, Groton;
Douglas A. Voorhies, Framingham;
David B. Kirk, Concord,
all of Mass. --

Signed and Sealed this

Sixth Day of August, 1991

*Attest:*

*Attesting Officer*

HARRY F. MANBECK, JR.

*Commissioner of Patents and Trademarks*